US006655814B1

(12) United States Patent
Tagawa et al.

(10) Patent No.: US 6,655,814 B1
(45) Date of Patent: Dec. 2, 2003

(54) LIGHT EMITTING BLOCK

(75) Inventors: Masaru Tagawa, Himeji (JP); Harumi Takeda, Osakasayama (JP)

(73) Assignee: Tadahiro Tagawa, Hyogo (JP)

( * ) Notice: Subject to any disclaimer, the term of this patent is extended or adjusted under 35 U.S.C. 154(b) by 0 days.

(21) Appl. No.: 10/110,048

(22) PCT Filed: Oct. 13, 2000

(86) PCT No.: PCT/JP00/07126

§ 371 (c)(1),
(2), (4) Date: Apr. 8, 2002

(87) PCT Pub. No.: WO01/27405

PCT Pub. Date: Apr. 19, 2001

(30) Foreign Application Priority Data

Oct. 15, 1999 (JP) ..... 11-293983

(51) Int. Cl.[7] ..... F21W 131/10
(52) U.S. Cl. ..... 362/183; 362/145; 362/153.1
(58) Field of Search ..... 362/184, 183, 362/145, 153, 153.1

(56) References Cited

U.S. PATENT DOCUMENTS

| | | | | |
|---|---|---|---|---|
| 5,594,313 A | | 1/1997 | Takeda | |
| 5,680,033 A | * | 10/1997 | Cha | 320/61 |
| 5,839,816 A | * | 11/1998 | Varga et al. | 362/153.1 |
| 5,984,570 A | * | 11/1999 | Parashar | 404/14 |
| 6,210,017 B1 | * | 4/2001 | Miura et al. | 362/153.1 |

FOREIGN PATENT DOCUMENTS

| | | |
|---|---|---|
| JP | 57-147438 | 9/1982 |
| JP | 59-051383 | 4/1984 |
| JP | 59-052383 | 4/1984 |
| JP | 61-022082 | 2/1986 |
| JP | 6-52467 | 7/1994 |
| JP | 6-052467 | 7/1994 |
| JP | 11-175014 | 7/1999 |

OTHER PUBLICATIONS

International Search Report PCT/JP00/07126 mailed on Feb. 13, 2001.

Translation of International Preliminary Examination Report mailed on Jun. 12, 2002.

* cited by examiner

*Primary Examiner*—Laura K. Tso
(74) *Attorney, Agent, or Firm*—Rader Fishman & Grauer

(57) ABSTRACT

A light emitting block of this invention includes, mounted in a main block body (1), solar batteries for (2) for generating light emitting electric power, an electric double layer capacitor (3) for storing the electric power, a planar light emitting member (4), and a light emission control circuit for controlling lighting of the planar light emitting portion (4). In the daytime, the solar batteries (2) receive ambient sunlight through a block surface portion (1A). The electric power of solar batteries (2) accumulates in the double layer capacitor (3). At nighttime, a light emitting surface (4A) of planar light emitting portion (4) automatically emits light with the electric power stored in the electric double layer capacitor (3), to make the block shine. The in-system power generating function provided by the solar batteries (2) and electric double layer capacitor (3) simplifies construction and maintenance, and maintains light emission even in time of blackout, which provides improved response to emergency situations. The planar light emission is mellow to the eye, which provides an improvement in design.

19 Claims, 8 Drawing Sheets overvoltage protection circuit
voltage stabilizer circuit
booster circuit
emission control circuit
6
7
8
9
10
2
2
3
4E 4F 4G 4H
4I,4J,4K,4L
SW1
SW2

LIGHT EMITTING BLOCK

TECHNICAL FIELD

This invention relates to light emitting blocks laid on side wall surfaces of garages, gardens and roads, or on wall surfaces of buildings and houses.

BACKGROUND ART

As one type of blocks laid on side wall surfaces provided for garages, gardens and roads, or on wall surfaces of buildings and houses, light collecting blocks are known, which are formed of transparent or translucent glass to take in sunlight from the ambient.

Conventionally, side wall surfaces of a garage or wall surfaces of a house have light collecting blocks arranged in positions where it is desired to take in sunlight from the ambient, and ordinary blocks arranged in other positions. During the daytime, ambient sunlight is allowed to pass through and taken in by the light collecting blocks to aid in illuminating the interior of the garage, building or house, to help in activities in the garage, building or house. However, during the nighttime, no sunlight is available from the ambient and the garage or house interior cannot be illuminated.

That is, the light collecting blocks as the conventional blocks are not effectively used when there is no sunlight from the ambient as at nighttime.

Having regard to the state of the art noted above, the object of this invention is to provide light emitting blocks excellent in response to emergency situations as well as workability, maintainability and design.

DISCLOSURE OF THE INVENTION

A light emitting block according to this invention is characterized by containing solar batteries arranged to receive sunlight penetrating a block surface portion to generate an electromotive force, an electric double layer capacitor for storing electric power generated by the solar batteries, a light emitting device disposed with a light emitting surface thereof opposed to a reverse surface of a block surface portion from which light is to be emitted, and an emission control device operable, when ambient illuminance is below a predetermined illuminance level, for automatically supplying the electric power stored in the electric double layer capacitor to the light emitting device to illuminate the light emitting surface of the light emitting device.

Such a light emitting block is applied to an attaching surface such as a side wall of a garage or a wall of a house. After application, sunlight passes through translucent regions of the block surface portion of the light emitting block, and strikes on the solar batteries. The solar batteries having received the sunlight generate electric power, and accumulate the electric power in the electric double layer capacitor at the same time.

When ambient illuminance falls below the predetermined illuminance level toward the evening, the emission control device automatically supplies the power stored in the double layer capacitor to the light emitting device, whereby the light emitting surface of the light emitting device begins to shine. The light emitted from the light emitting surface passes through the translucent regions of the block surface portion to radiate from the block to the ambient. In this way, the light emitting block performs a light emitting function.

That is, the light emitting block of this invention has an in-system power generating function provided by the solar batteries and electric double layer capacitor. All that is required is to lay the light emitting block in place. There is no need for a wiring operation or a subsequent checking operation. Moreover, there is no possibility of light emission stoppage in time of power failure due to a natural disaster or the like. The light emitting function is firmly maintained.

Thus, the light emitting block according to this invention has an appropriate in-system power generating function provided by the solar batteries and electric double layer capacitor. There is no need for a wiring operation or a subsequent checking operation, to realize improved workability and maintainability. Moreover, there is no possibility of light emission stoppage in time of unexpected power failure due to a natural disaster or the like, which provides improved response to emergency situations.

In the light emitting block of this invention, the light emitting device preferably comprises a planar light emitting device or a point light emitting device.

The light emitting device comprising a planar light emitting device as noted above is not too dazzling or offensive to view, which provides an improvement in design over the prior art. The light emitting device comprising a point light emitting device emits light farther than the planar light emitting device.

In the light emitting block of this invention, the planar light emitting device preferably has a transparent plate disposed parallel to the block surface portion, a light projecting device for injecting light from end surfaces of the transparent plate into the transparent plate along a direction of a plane thereof, a light scattering device with a surface of the transparent plate close to the block surface portion acting as a light scattering surface, and a light reflecting device with a surface of the transparent plate remote from the block surface portion acting as a light reflecting surface.

In time of light emission, the light injected by the light projecting device into the transparent plate along the direction of the plane thereof is reflected and deflected toward the block surface portion by the light reflecting surface on the reverse side. Then, the light, while being scattered by the light scattering surface on the front side, radiates to the ambient from the translucent regions of the block surface portion. Since a large part of incident light is released after the reflection from the light reflecting surface, the light emitting surface is bright. The light emitting surface gives a very mellow (soft) impression as a result of the light scattering action (light diffusion) of the light scattering surface.

BEST MODE FOR CARRYING OUT THE INVENTION

Modes for solving the problem of the prior art include the following:

First Embodiment

Figure 1:
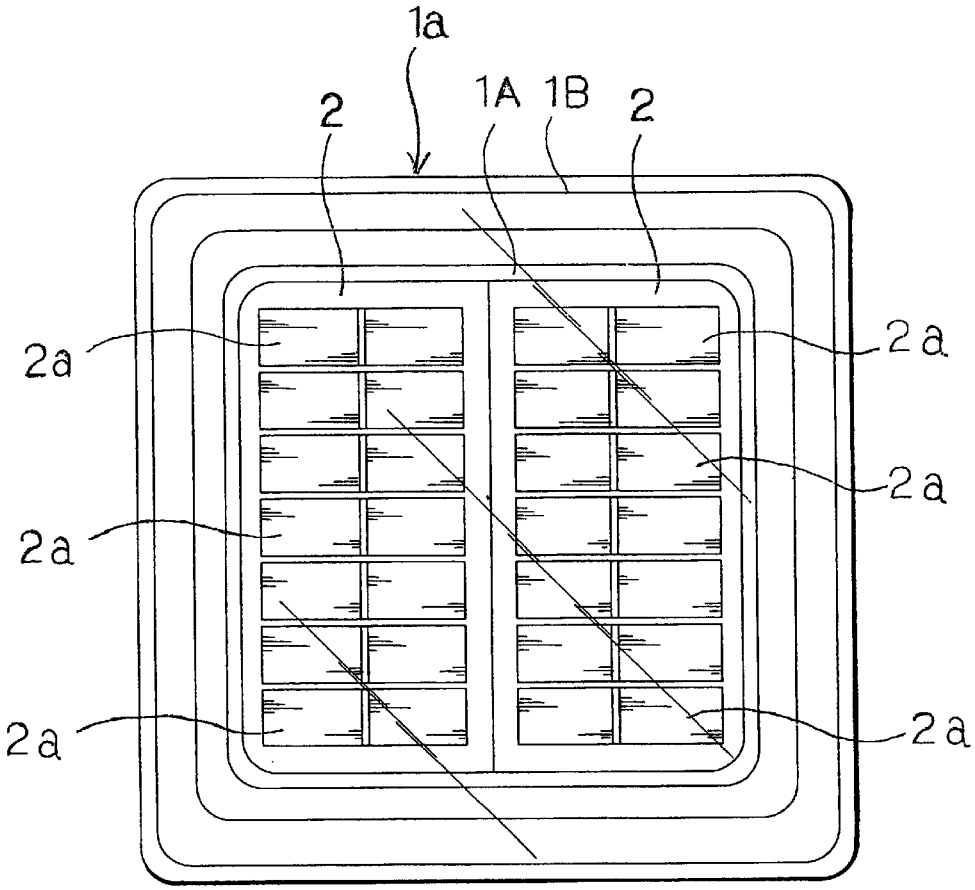
FIG. 1 is a plan view of a light emitting block in a first embodiment seen from solar batteries.

The first embodiment will be described with reference to the drawings. FIG. 1 is a plan view of a light emitting block in the first embodiment seen from solar batteries, FIG. 2 is a view in vertical section showing an interior structure of the light emitting block in the first embodiment, FIG. 3 is a plan view of the light emitting block in the first embodiment seen from a light emitting device, and FIG. 4 is a circuit diagram showing an electric circuit of the light emitting block in the first embodiment.

Figure 2:
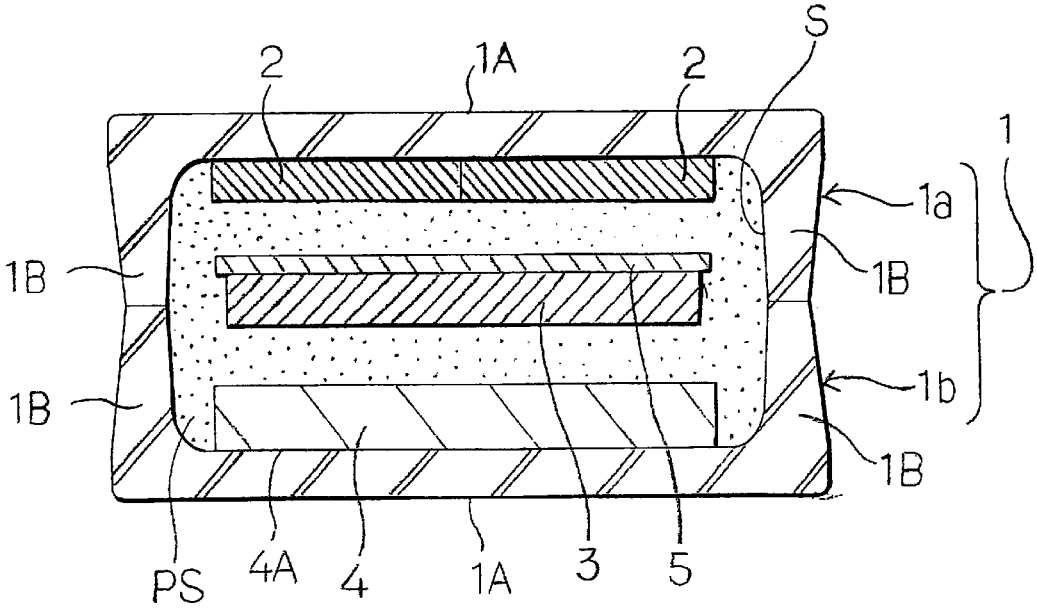
FIG. 2 is a sectional view showing an interior structure of the light emitting block in the first embodiment.
Figure 3:
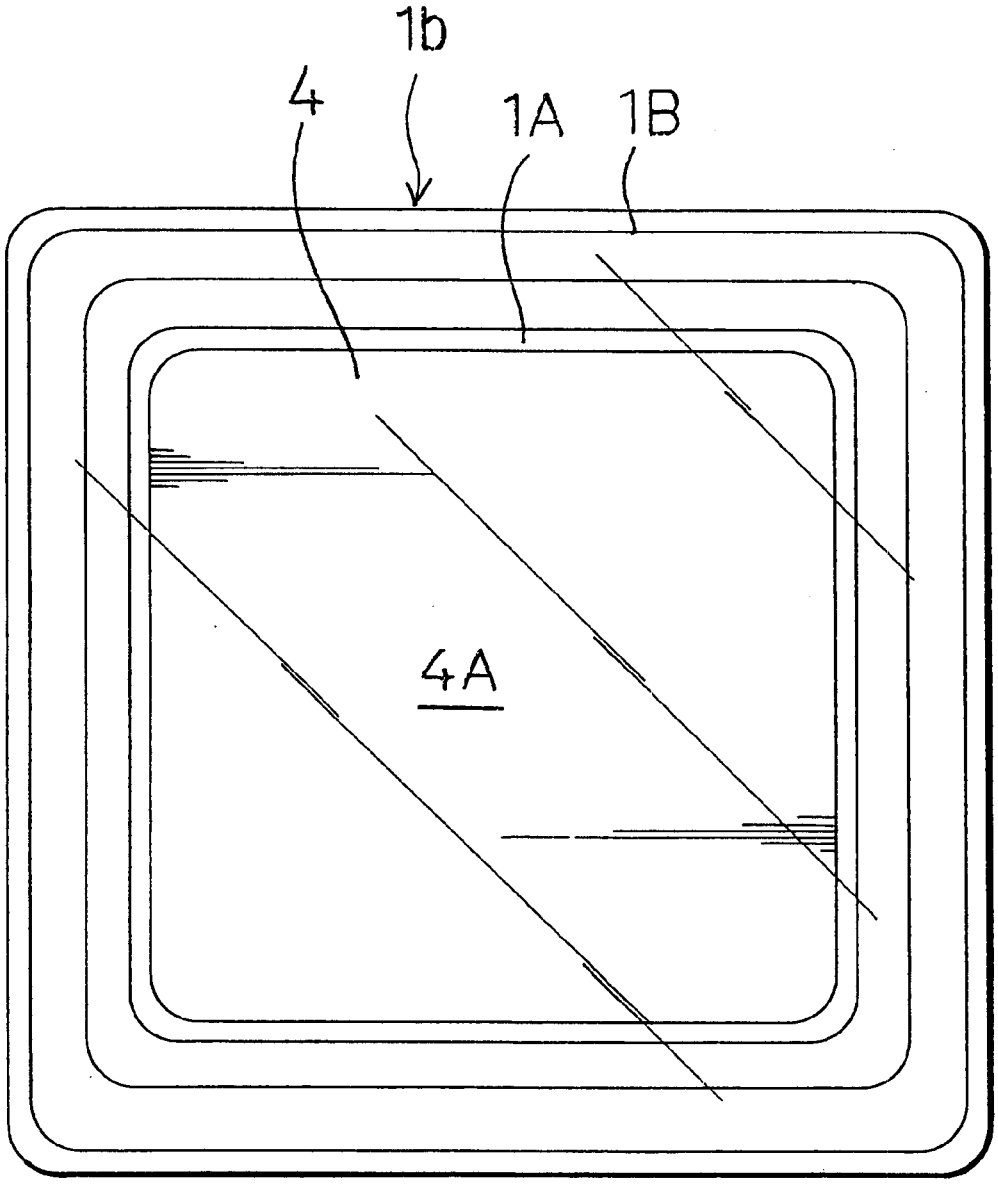
FIG. 3 is a plan view of the light emitting block in the first embodiment seen from a planar light emitting device.
Figure 4:
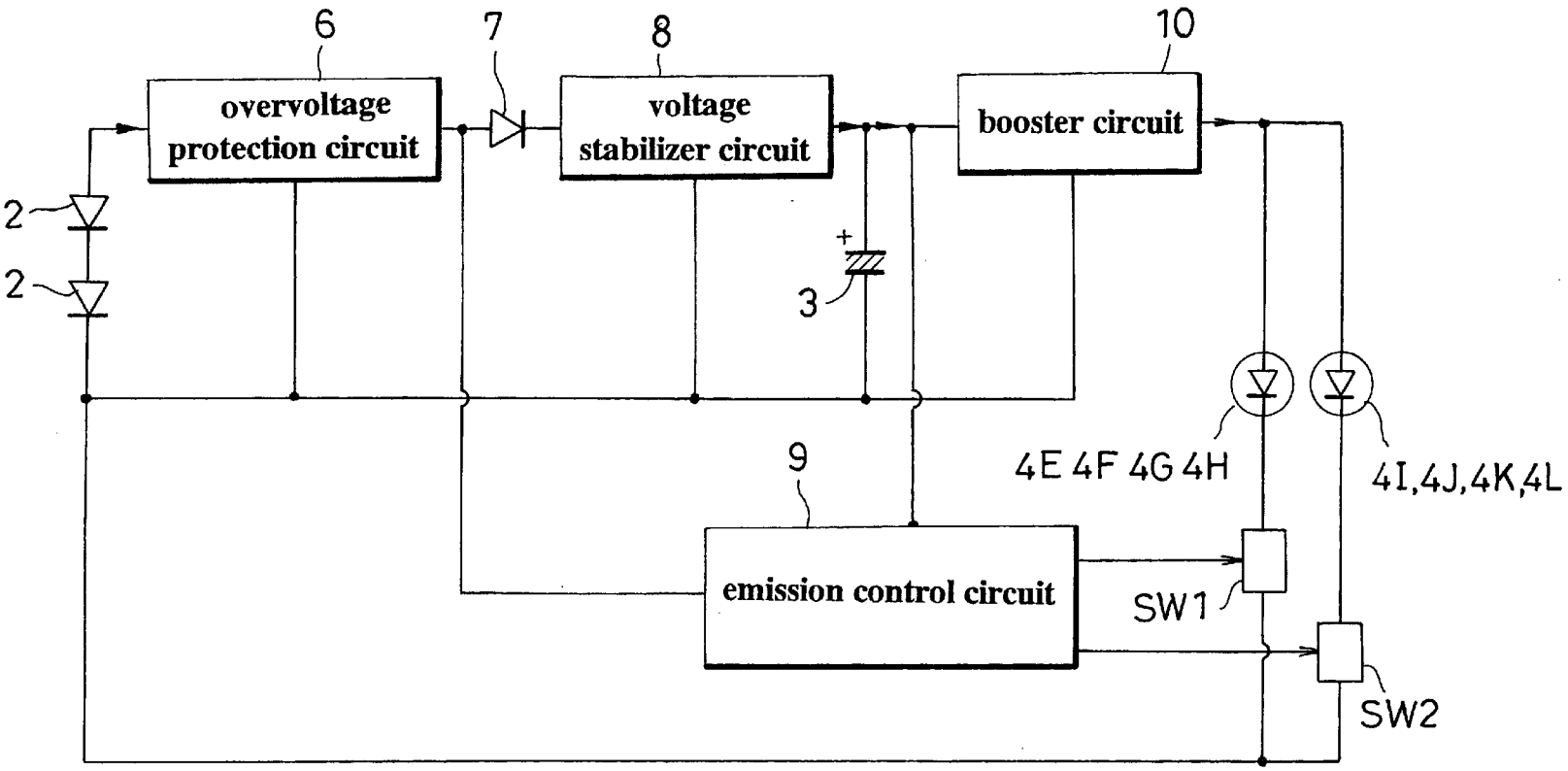
FIG. 4 shows an electric circuit of the light emitting block in the first embodiment.

As shown in FIGS. 1 through 3, the light emitting block in the first embodiment includes a main block body 1 formed of a first and a second boxes 1*a* and 1*b*, and a light emitting functional portion.

As shown in FIG. 2, the main block body 1 has the first and second boxes 1*a* and 1*b* formed of transparent glass and having a square shape, with respective openings opposed to each other. The first and second boxes 1*a* and 1*b* have the same configuration, with bottom walls thereof acting as plate-like block surface portions 1A. Side walls of the first and second boxes 1*a* and 1*b* act as legs 1B for supporting the block surface portions 1A. Since the first and second boxes 1*a* and 1*b* are formed of transparent glass, the entire block surface portions 1A of the first and second boxes 1*a* and 1*b* act as translucent regions.

The light emitting block in the first embodiment is embedded, with a block surface portion 1A exposed, in a desired location such as a side wall of a garage or an interior wall of a house. The block surface portion 1A constitutes a wall surface. Numerous light emitting blocks may be arranged in a matrix form, or only a single light emitting block may be used on its own.

The light emitting functional portion will be described next.

This light emitting functional portion includes components necessary to perform a light emitting function, and is disposed in an interior space of main block body 1. The components necessary to perform the light emitting function are stored in a space S formed in the back of the block surface portions 1A by the plate-like block surface portions 1A and legs 1B.

Specifically, as shown in FIGS. 1 through 3, the space S of the block surface portions 1A accommodates solar batteries 2 for generating electric power for light emission, an electric double layer capacitor 3 for storing the power generated by the solar batteries 2, a planar light emitting member 4 for radiating light from surfaces of the block surface portions 1A to the ambient, and a printed board 5 having an emission control circuit for lighting the planar light emitting member 4.

During the daytime when sunlight pours down, the power generated by the solar batteries 2 accumulates in the electric double layer capacitor 3. On the other hand, when it grows darker toward the evening with the sun setting, the power stored in the electric double layer capacitor 3 is supplied to the planar light emitting member 4. Then, a light emitting surface 4A of the planar light emitting member 4 automatically emits light, causing the block to shine.

In the light emitting block in the first embodiment, the solar batteries 2 which receive sunlight from the ambient are disposed directly under the block surface portion 1A of the first box 1*a*, and the planar light emitting member 4 which releases light to the ambient is disposed directly under the block surface portion 1A of the second box 1*b*. The electric double layer capacitor 3 and printed board 5 having no immediate relationship with the ambient are arranged between the solar batteries 2 and planar light emitting member 4.

The components of the light emitting block in the first embodiment will be described in detail hereinafter.

In the first embodiment, the space S in the back of the block surface portions 1A of the first and second boxes 1*a* and 1*b* is made fully waterproof with a resin sealing, which is achieved by filling a waterproof resin PS through the openings after the components necessary for the light emitting function are mounted in place. Thus, when the light emitting block in the first embodiment is applied to a wall surface, the components in the space S of the block surface portions 1A are protected from moisture and water.

As shown in FIG. 1, the light emitting block in the first embodiment has two solar batteries 2 placed substantially throughout the block surface portion 1A of the first box 1*a*, in a series arrangement for receiving sunlight penetrating the block surface portion 1A to generate electromotive forces simultaneously. In the first embodiment, each solar battery 2 includes seven unit cells 2a connected in series. Of course, the number of unit cells in each solar battery 2 is not limited to a particular number. A suitable number, one or more, is selected according to a voltage required of each solar battery 2.

In the light emitting block in the first embodiment, as shown in FIG. 4, the solar batteries 2 are connected in series to the electric double layer capacitor 3, and the power generated by each solar battery 2 is stored in the electric double layer capacitor 3. The light emitting block in the first embodiment is used on a wall surface or the like, and therefore foreign objects such as fallen leaves or waste paper about to adhere to the block surface portion will fall by gravity. There is hardly any possibility that the solar batteries 2 are partly covered with foreign objects. Thus, sufficient power may be stored since contamination of the block will not affect the power storing function. The solar batteries 2 may therefore be connected in series to provide an increased voltage required.

Three or more solar batteries 2 may be used to form a series/parallel connection according to a voltage required, instead of connecting all the solar batteries 2 in series. Though only one electric double layer capacitor 3 is shown in FIG. 4, a plurality of such capacitors may be connected in parallel according to an electrostatic capacity needed.

A total quantity of power generated by the above solar batteries 2 is determined to cope with a small quantity of solar radiation during the daytime in a spell of cloudy or rainy weather. Thus, even in such conditions, the electric double layer capacitor 3 is charged with electric power to be consumed by a load for the day. The electric double layer capacitor 3 has a capacity for storing at least the quantity of electric power consumed by the load in a day. Thus, the capacity of electric double layer capacitor 3 provides a margin 1/5 to 1/30 of a conventional storage battery. The electric double layer capacitor 3 is much smaller and lighter than the conventional storage battery.

In the first embodiment, as shown in FIG. 4, an overvoltage protection circuit 6, a reverse flow preventive diode 7 and a voltage stabilizer circuit 8 are connected between the solar batteries 2 and electric double layer capacitor 3.

The overvoltage protection circuit 6 is provided to prevent the charging voltage of solar batteries 2 from reaching an overcharging voltage in excess of a permissible voltage. During the nighttime when no electromotive force is generated by the solar batteries 2, power could inadvertently flow from the electric double layer capacitor 3 having a high voltage back to the solar batteries 2. The reverse flow preventive diode 7 prevents such a reverse flow of the power stored in the electric double layer capacitor 3. The voltage stabilizer circuit 8 prevents variations in the charging voltage and maintains it constant.

Where sunshine is stable to render voltage generation relatively stable, one or both of the reverse flow preventive diode 7 and voltage stabilizer circuit 8 may be omitted. This will simplify the construction.

Figure 5:
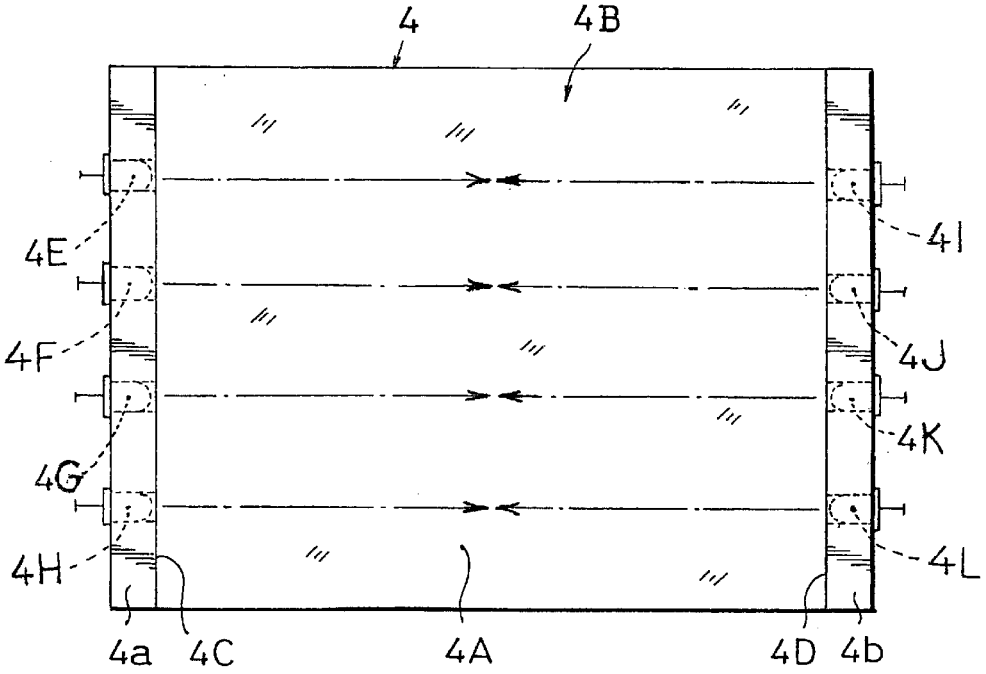
FIG. 5 is a plan view showing a construction of a planar light emitting member of the light emitting block in the first embodiment.

On the other hand, as shown in FIG. 5, the planar light emitting member 4 has a transparent plate 4B disposed parallel (i.e. opposed surfaces being parallel) to the block surface portion 1A, and eight light emitting diodes (LEDs) 4E–4L for injecting light from a pair of opposite end surfaces 4C and 4D of the transparent plate 4B into the transparent plate 4B along a direction of a plane thereof. The transparent plate 4B has a surface 4M opposed to the block surface portion 1A and acting as a light scattering surface. The transparent plate 4B has a surface (reverse surface) 4N remote from the block surface portion 1A, which acts as a light reflecting surface.

The light emitting diodes 4E–4H and light emitting diodes 4I–4L are distributed to and arranged on the end surface 4C and the end surface 4D, such that light enters the transparent plate 4B in coinciding directions as shown in dot-and-dash lines in FIG. 5. These light emitting diodes 4E–4L are inserted and fixed in bores formed in elongate, white opaque resin pieces 4*a* and 4*b* placed in close contact with the end surfaces 4C and 4D of transparent plate 4B.

Where irregularity occurs with the light emission from the light emitting surface 4A, the irregularities may be suppressed by arranging the light emitting diodes 4E–4H and light emitting diodes 4I–4L alternately. On the other hand, where no light emission irregularity occurs or light emission irregularity presents no problem in use, only those on one side may be provided, of the light emitting diodes 4E–4H and 4I–4L arranged on the opposite sides.

Figure 6:
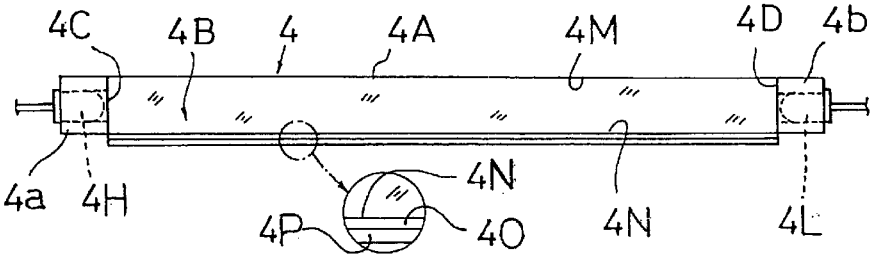
FIG. 6 is a side view showing the construction of the planar light emitting member of the light emitting block in the first embodiment.

In the first embodiment, the transparent plate 4B is in the form of a colorless, transparent acrylic plate. The light scattering surface (light scattering device) is formed by sand-blasting the surface 4M, while the light reflecting surface, as shown in FIG. 6, is formed by laminating a white coating 4O (light reflecting device) and a white sheet 4P (light reflecting device) on the reverse surface 4N.

The light scattering surface may be formed by laminating a light scattering sheet (light scattering device) on the surface 4M. The light reflecting surface may also be formed by applying a metal film to the reverse surface 4N, or laminating a mirror sheet thereon for mirror reflection of incident light.

Further, the end surfaces 4C and 4D of transparent plate 4B act as reflecting surfaces which are provided by white surfaces of opaque resin pieces 4*a* and 4*b*. The two remaining end surfaces of transparent plate 4B also are made reflecting surfaces such as by forming white coatings (not shown) thereon. Of course, each end surface of transparent plate 4B may define a reflecting surface having a metallic mirror layer or the like.

Figure 7:
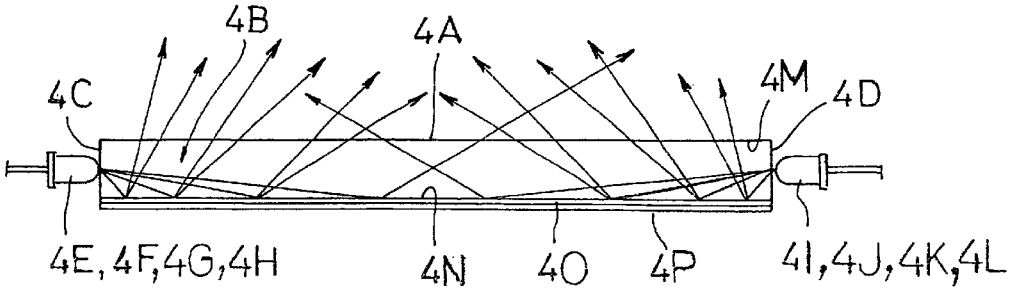
FIG. 7 is a schematic view showing light reflections in the planar light emitting member of the light emitting block in the first embodiment.

When the light emitting diodes 4E–4L are lit, as shown in FIG. 7, the light entering the transparent plate 4B from the light emitting diodes 4E–4L is reflected by the light reflecting surface defined by the reverse surface 4N to travel toward the block surface portion 1A. The light radiates from the block surface portion 1A to the ambient while being scattered by the light scattering surface defined by the surface 4M. Since the planar light emitting member 4 is a planar light emitter, the light emitting surface 4A is mellow and pleasing to the eye. Since a large part of incident light is released after being reflected by the light reflecting surface, the light emitting surface 4A is bright. The light emitting surface 4A gives a very mellow impression as a result of the light scattering function (light diffusion) of the light scattering surface.

The light emitting diodes 4E–4L of planar light emitting member 4 are operable under the following lighting control by an emission control circuit 9.

When ambient illuminance L is found equal to or below a predetermined illuminance Lon, the emission control circuit 9 supplies the power stored in the electric double layer capacitor 3 to the light emitting diodes 4E–4L of planar light emitting member 4. Conversely, when ambient illuminance L is found equal to or above a predetermined illuminance Loff, the emission control circuit 9 stops the power supply to the light emitting diodes 4E–4L. In the first embodiment, the electromotive force of solar batteries 2 is used as a detection signal indicative of ambient illuminance L. The solar batteries 2 act also as optical sensors, and the electromotive force of solar batteries 2 is in a proportional relationship to ambient illuminance. It is therefore possible to utilize the electromotive force of solar batteries 2 in determining whether the ambient illuminance L is in the illuminance (darkness) level for causing the light emitting block to emit light or not.

The emission control circuit 9 in the first embodiment has the predetermined illuminance Lon for starting the power supply, which is slightly lower than the predetermined illuminance Loff for stopping the power supply. If the same illuminance were set for starting and stopping the power supply, a chattering phenomenon would occur to repeat starting and stopping of the power supply frequently in response to slight illuminance variations. To avoid such chattering phenomenon, what is known as hysteresis property is provided, whereby the power supply is not stopped after it is started at the predetermined illuminance Lon, unless the ambient illuminance L increases to the slightly higher illuminance Loff.

As shown in FIG. 4, the accumulated power is supplied from the electric double layer capacitor 3 to anodes of light emitting diodes 4E–4L via a booster circuit 10, and cathodes of light emitting diodes 4E–4L are connected to a common line (grounding line) through switching elements SW1 and SW2. When the accumulated power is supplied, the emission control circuit 9 turns on the switching elements SW1 and SW2 whereby currents flow to the light emitting diodes 4E–4L to light the latter. The operation frequency for turning on the switching elements SW1 and SW2 is 60 Hz (hertz), for example. The light emitting diodes 4E–4L emit light with this operation frequency.

In the first embodiment, the switching elements SW1 and SW2 are alternately turned on in a short time for power saving purposes. That is, the light emitting diodes 4E–4L blink at high speed. This presents no problem since light emission appears to occur continuously in the human eye due to afterglow.

The switching elements SW1 and SW2 may be in the form of transistors, for example. Where the light emitting diodes have a low rated voltage, the booster circuit 10 may be omitted so that the electric double layer capacitor 3 supplies the accumulated power directly to the light emitting diodes. Alternatively, the booster circuit 10 may be formed of a DC-DC converter to effect a negative boosting, i.e. step-down, to lower the voltage.

The light emitting block in the first embodiment has, mounted en bloc on the printed board 5, the overvoltage protection circuit 6, reverse flow preventive diode 7, voltage stabilizer circuit 8, emission control circuit 9, switching elements SW1 and SW2 and booster circuit 10, as well as the electric double layer capacitor 3.

Operation of the light emitting block in the first embodiment having the above construction will be described hereinafter.

During the daytime when the sun is up, each solar battery 2 receiving sunlight generates electric power and transmits it to the electric double layer capacitor 3. As a result, power accumulates in the electric double layer capacitor 3. Ambient illuminance is high during the daytime, and the emission control circuit 9 maintains the switching elements SW1 and SW2 turned off. Thus, the light emitting diodes 4E–4L are maintained in off state with no current flowing thereto. The light emitting surface 4A does not shine at all.

Ambient illuminance L gradually lowers toward the evening. When ambient illuminance L falls to or below the predetermined illuminance Lon, the emission control circuit 9 alternately turns on the switching elements SW1 and SW2. Thus, currents flow to the light emitting diodes 4E–4L to light the latter. The light emitting surface 4A begins to shine to set the light emitting block to a state of light emission.

During the nighttime when the sun is sunk low, ambient illuminance L remains below the illuminance Lon and the light emitting block continues to maintain the emission state.

Toward daybreak, ambient illuminance L increases gradually. When ambient illuminance L returns to the predetermined illuminance Loff slightly higher than the predetermined illuminance Lon, the emission control circuit 9 turns off the switching elements SW1 and SW2 again. The currents stop flowing to the light emitting diodes 4E–4L to turn off the latter. Thus, the light emitting surface 4A stops shining, and the light emitting block switches to a non-emission state.

As described above, the light emitting block in the first embodiment has an appropriate in-system power generating function provided by the solar batteries 2 and electric double layer capacitor 3. There is no need for a wiring operation or a subsequent checking operation, to realize improved workability and maintainability. Moreover, the light emitting block continues to emit light even in time of blackout, which provides improved response to emergency situations. The planar light emitting member 4, as it is planar, is not too dazzling or offensive to view, which provides an improvement in design.

Figure 8:
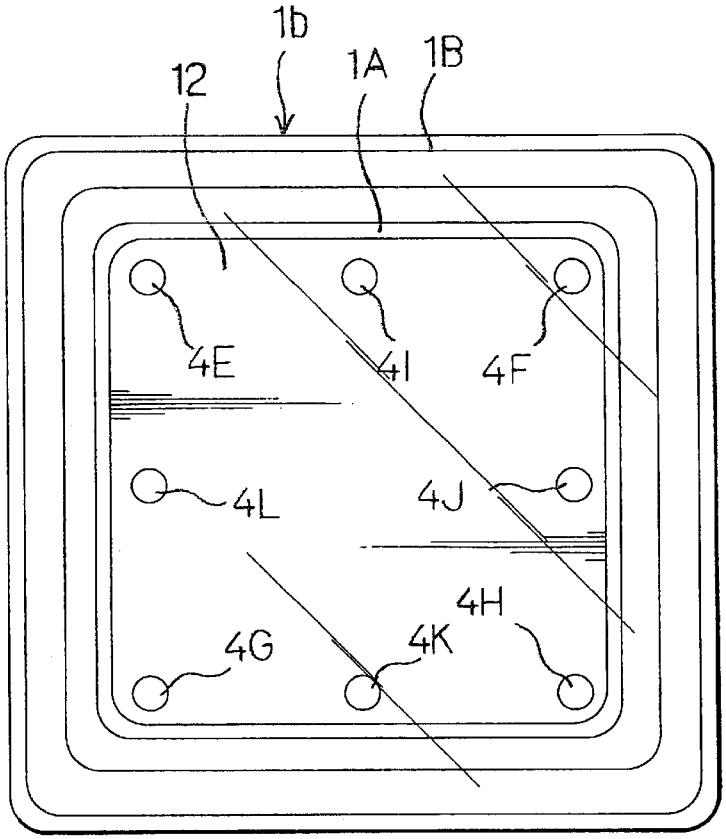
FIG. 8 is a plan view of a light emitting block in a second embodiment seen from a point light emitting device.
Figure 9:
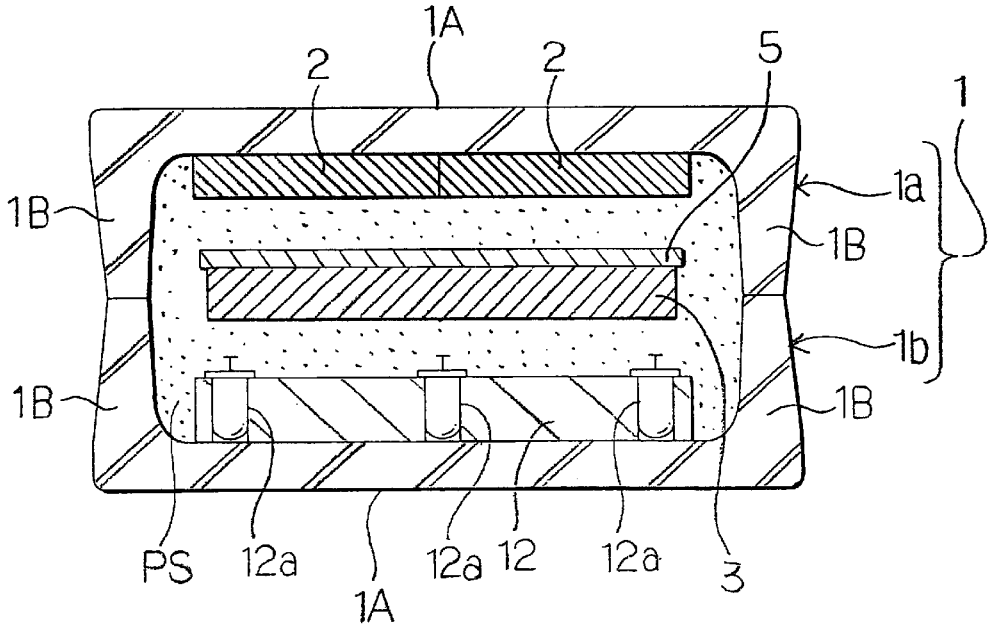
FIG. 9 is a sectional view showing an interior structure of the light emitting block in the second embodiment.

This invention is not limited to the first embodiment described above, but may be modified as follows:

(1) In the light emitting block in the first embodiment described above, the light emitting device comprises the planar light emitting member 4 acting as a planar light emitting device. In a modification, as shown in FIGS. 8 and 9, the light emitting device may comprise a point light emitting device. This modification will be described hereinafter as a second embodiment.

Second Embodiment

The point light emitting device is realized by placing light emitting diodes 4E–4L in mounting bores 12*a* formed in a plate 12. With the light emitting block in this second embodiment, the light emitting diodes 4E–4L emit light to shine directly upon a target location, and therefore to reach farther than the light from the planar light emitting device in the first embodiment. Thus, the light reflecting device and light scattering device used in the first embodiment may be dispensed with.

The mounting bores 12*a* formed in the plate 12 of the point light emitting device may be formed at an angle, instead of perpendicular, to the surface of plate 12 contacting the block surface portion 1A, or the plate 12 per se may be disposed at an angle to the block surface portion 1A. In this way, light may be emitted in different directions to irradiate different locations. An area around the feet may be illuminated, for example.

(2) In the light emitting block in the first embodiment, the light emitting diodes 4E–4L are turned on at 60 Hz (hertz). Instead, light emission may be performed at a frequency below 60 Hz (hertz), so that the intermittent light emission is perceptible to the human eye.

Figure 10:
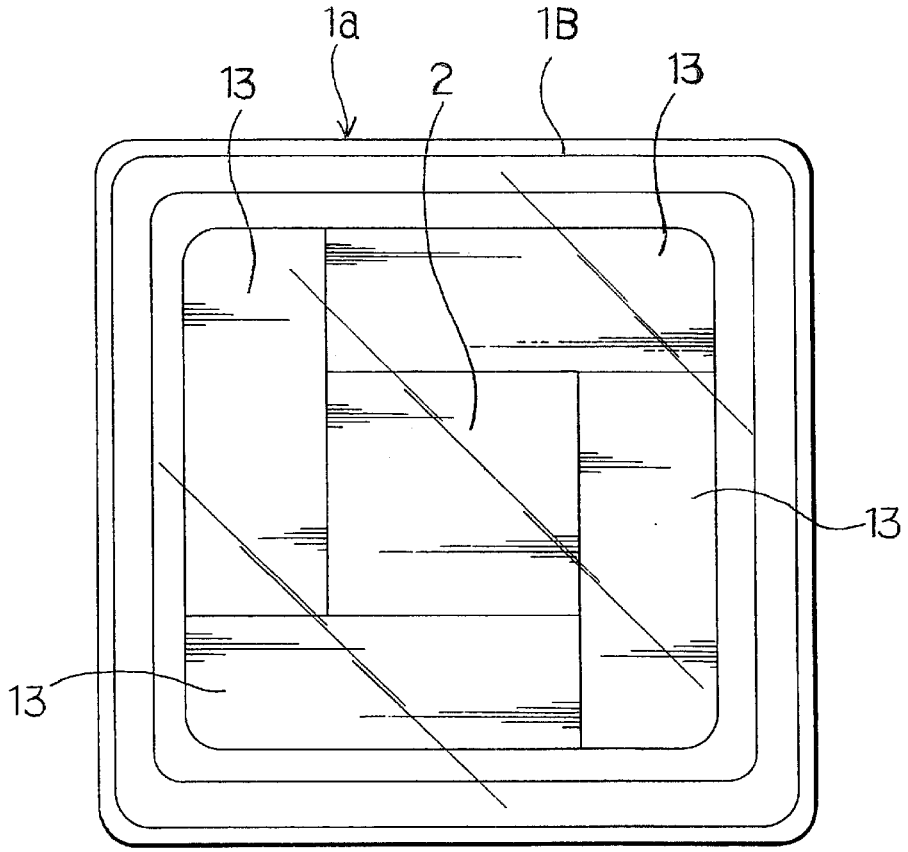
FIG. 10 is a plan view of a light emitting block in a third embodiment seen from solar batteries.
Figure 11:
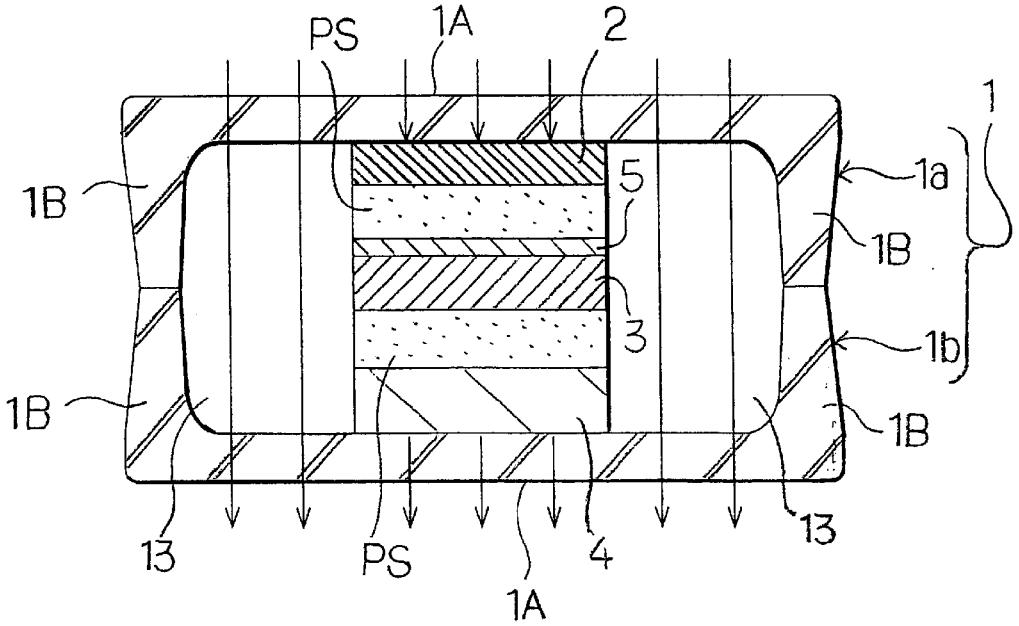
FIG. 11 is a sectional view showing an interior structure of the light emitting block in the third embodiment.

(3) In the light emitting block in the first embodiment, the solar batteries 2 and the planar light emitting member 4 acting as the light emitting device are placed substantially throughout the block surface portions, respectively. In a modification, as shown in FIGS. 10 and 11, the solar batteries 2 and planar light emitting member 4 may be reduced in area, compared with the block surface portions. This modification will be described hereinafter as a third embodiment.

Third Embodiment

Light collecting portions 13 are formed in the space produced as a result of diminishing the solar batteries 2 and planar light emitting member 4. These light collecting portions 13 are formed, for example, by filling a translucent resin, or by being left completely hollow.

In the daytime the solar batteries 2 at the block surface portion 1A receive sunlight and generate electric power. The power is stored in the electric double layer capacitor 3. Ambient sunlight passes to be collected through the parts of block surface portions 1A not blocked by the solar batteries 2 or planar light emitting portion 4 to aid in illuminating a garage interior, building interior or house interior.

When ambient illuminance L falls to or below the predetermined illuminance in the evening, the emission control device automatically supplies the power stored in the electric double layer capacitor 3 to the planar light emitting member 4. Then, the light emitting surface of planar light emitting member 4 begins to shine. The light exiting the light emitting surface passes through the block surface portion 1A to be released to areas around the light emitting block, thereby fulfilling the light emitting function of the light emitting block.

Figure 12:
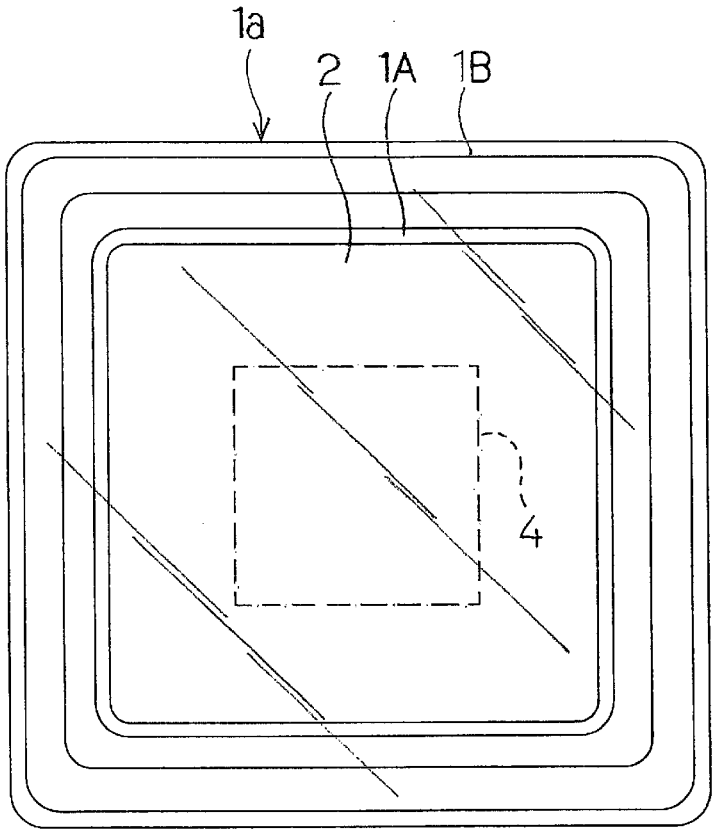
FIG. 12 is a plan view of a light emitting block in a fourth embodiment seen from solar batteries.
Figure 13:
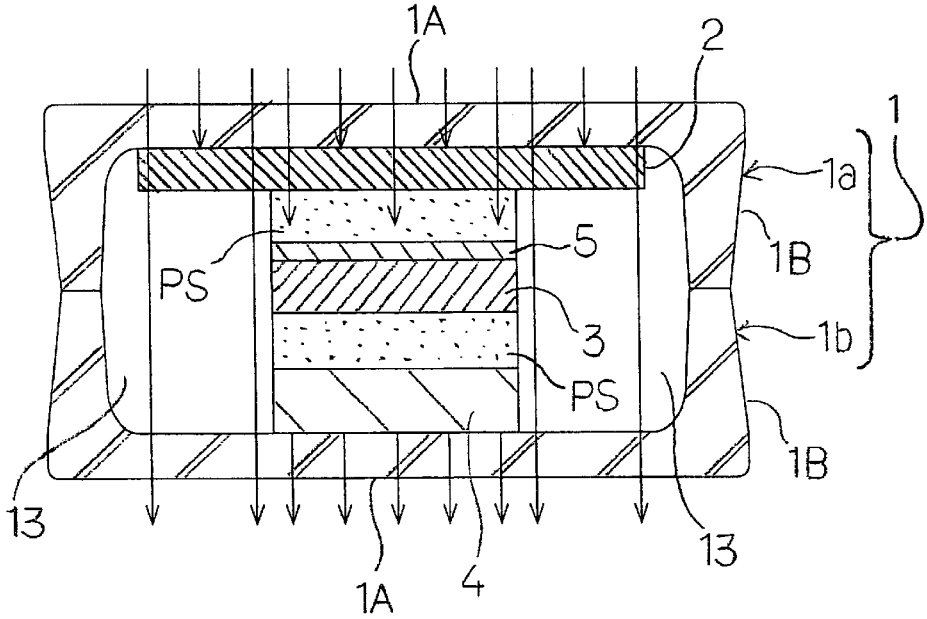
FIG. 13 is a sectional view showing an interior structure of the light emitting block in the fourth embodiment.

(4) In the light emitting block in the above third embodiment, as shown in FIGS. 10 and 11, the solar batteries 2 and planar light emitting portion 4 have a smaller area than the block surface portions. In a modification, as shown in FIGS. 12 and 13, the solar batteries 2 comprise the semi-transmission type for transmitting part of incident sunlight, and the planar light emitting member 4 acting as the light emitting device has a smaller area than the block surface portions 1A. This modification will be described hereinafter as a fourth embodiment.

Fourth Embodiment

Light collecting portions 13 are formed in the space produced as a result of diminishing the planar light emitting member 4. These light collecting portions 13 are formed, for example, by filling a translucent resin, or by being left completely hollow.

In the daytime the semi-transmission type solar batteries 2 at the block surface portion 1A intercept part of sunlight and generate electric power. The power is stored in the electric double layer capacitor 3. The sunlight not intercepted by the semi-transmission type solar batteries 2 passes through the light collecting portions 13 to be taken into a garage, building or house to aid in illuminating the interior of the garage, building or house.

When ambient illuminance L falls to or below the predetermined illuminance in the evening, the emission control device automatically supplies the power stored in the electric double layer capacitor 3 to the planar light emitting member 4. Then, the light emitting surface of planar light emitting member 4 begins to shine. The light exiting the light emitting surface passes through the block surface portion 1A to be released to areas around the light emitting block, thereby fulfilling the light emitting function of the light emitting block.

(5) The light emitting block in the first embodiment uses the planar light emitting member 4 of the light emitting diode type. In a modification, the planar light emitting member 4 may be formed of an EL (electro-luminescence) element. Further, the planar light emitting member may be formed of a cold-cathode tube or xenon tube.

(6) The light emitting block in the first embodiment may be modified such that, where the charging voltage of electric double layer capacitor 3 is insufficient, a further solar battery or batteries 2 may be connected in series to increase the charging voltage, or where the electric double layer capacitor 3 has an insufficient voltage endurance, electric double layer capacitors 3 may be connected in series to increase the voltage endurance.

(7) In the light emitting block in the first embodiment, the entire block surface portion 1A provides a translucent region. The entire block surface portion 1A need not provide a translucent region, but only a necessary part thereof may provide a translucent region.

(8) In the light emitting block in the first embodiment, the first and second boxes 1*a* and 1*b* have the same configuration. For example, one of them may be in the form of a square box, and the other in a complete plate form. The first and second boxes 1*a* and 1*b* may be shaped in any way as long as they may be installed in place with the components necessary for the light emitting function sealed inside. While the first and second boxes 1*a* and 1*b* are formed of transparent glass, they may be formed of a resin or may be colored with transparency.

Figure 14:
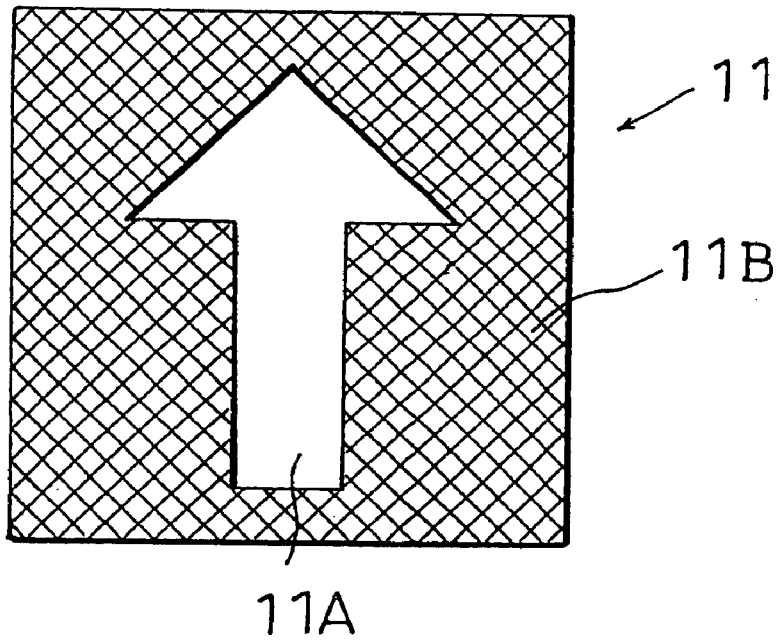
FIG. 14 is a plan view showing a display sheet employed in a modified light emitting block.

(9) The light emitting block in the first embodiment may be modified to include a display plate 11 (display member) as shown in FIG. 14, which is laminated on the light emitting surface 4A.

The display plate 11 defines an arrow mark formed by combining an arrow-shaped transparent region 1A (light transmitting region) with a black region 11B (light shielding region). The arrow mark may be recognized at night owing to the light emitting function of the light emitting block.

The display plate 11 has the reverse side of light shielding region 11B formed as a mirror surface. All light radiates from the transparent region 1A without being absorbed by the black region 11B. This results in an outstanding difference in light quantity between the transparent region 1A and black region 11B to render the arrow mark clearly visible. This modified light emitting block has, besides the light emitting function, a displaying function based on the arrow mark serving as a display.

The type of display is of course not limited to the arrow mark. Instead of laminating the display plate 11, a display may be painted on the light emitting surface 4A.

(10) The light emitting blocks of this invention are not limited in application to embedment in side wall surfaces of garages, gardens and roads, or in wall surfaces of buildings and houses. The blocks may be placed on at least part of a fence at a construction site, for example. This allows the construction fence to be located readily at night.

INDUSTRIAL UTILITY

As described above, this invention is suited for application to light emitting blocks used on side wall surfaces of garages, gardens and roads, or on the wall surfaces of buildings and houses.

What is claimed is:

1. A light emitting block characterized by containing in a transparent or translucent block:

solar batteries arranged to receive sunlight penetrating a block surface portion to generate an electromotive force;

an electric double layer capacitor for storing electric power generated by the solar batteries;

light emitting means disposed with a light emitting surface thereof opposed to a reverse surface of a block surface portion from which light is to be emitted; and emission control means operable, when ambient illuminance is below a predetermined illuminance level, for automatically supplying the electric power stored in the electric double layer capacitor to the light emitting means to illuminate the light emitting surface of the light emitting means.

2. A light emitting block as defined in claim 1, characterized in that said light emitting means comprises planar light emitting means or point light emitting means.

3. A light emitting block as defined in claim 2, characterized in that said planar light emitting means has a transparent plate disposed parallel to the block surface portion, light projecting means for injecting light from end surfaces of the transparent plate into the transparent plate along a direction of a plane thereof, light scattering means with a surface of the transparent plate close to the block surface portion acting as a light scattering surface, and light reflecting means with a surface of the transparent plate remote from the block surface portion acting as a light reflecting surface.

4. A light emitting block as defined in claim 1, characterized in that said solar batteries and said light emitting means have smaller areas than the block surface portion.

5. A light emitting block as defined in claim 2, characterized in that said solar batteries and said light emitting means have smaller areas than the block surface portion.

6. A light emitting block as defined in claim 1, characterized in that said solar batteries comprise a semi-transmission type for transmitting part of incident sunlight, and that said light emitting means has a smaller area than the block surface portion.

7. A light emitting block as defined in claim 2, characterized in that said solar batteries comprise a semi-transmission type for transmitting part of incident sunlight, and that said light emitting means has a smaller area than the block surface portion.

8. A light emitting block as defined in claim 2, characterized in that said planar light emitting means has a display member formed on a light emitting surface thereof.

9. A light emitting block as defined in claim 3, characterized in that said planar light emitting means has a display member formed on a light emitting surface thereof.

10. A light emitting block as defined in claim 4, characterized in that said planar light emitting means has a display member formed on a light emitting surface thereof.

11. A light emitting block as defined in claim 5, characterized in that said planar light emitting means has a display member formed on a light emitting surface thereof.

12. A light emitting block as defined in claim 6, characterized in that said planar light emitting means has a display member formed on a light emitting surface thereof.

13. A light emitting block as defined in claim 7, characterized in that said planar light emitting means has a display member formed on a light emitting surface thereof.

14. A light emitting block as defined in claim 8, characterized in that said display member is formed by a combination of a light transmitting region and a light shielding region, with a light reflecting surface formed on a reverse side of the light shielding region.

15. A light emitting block as defined in claim 9, characterized in that said display member is formed by a combination of a light transmitting region and a light shielding region, with a light reflecting surface formed on a reverse side of the light shielding region.

16. A light emitting block as defined in claim 10, characterized in that said display member is formed by a combination of a light transmitting region and a light shielding region, with a light reflecting surface formed on a reverse side of the light shielding region.

17. A light emitting block as defined in claim 11, characterized in that said display member is formed by a combination of a light transmitting region and a light shielding region, with a light reflecting surface formed on a reverse side of the light shielding region.

18. A light emitting block as defined in claim 12, characterized in that said display member is formed by a combination of a light transmitting region and a light shielding region, with a light reflecting surface formed on a reverse side of the light shielding region.

19. A light emitting block as defined in claim 13, characterized in that said display member is formed by a combination of a light transmitting region and a light shielding region, with a light reflecting surface formed on a reverse side of the light shielding region.

* * * * *